US005434033A

United States Patent [19]

Kawai

[11] Patent Number: 5,434,033

[45] Date of Patent: Jul. 18, 1995

[54] SILVER HALIDE COLOR PHOTOGRAPHIC MATERIAL AND METHOD FOR FORMING A COLOR IMAGE

[75] Inventor: Kiyoshi Kawai, Minami-ashigara, Japan

[73] Assignee: Fuji Photo Film Co., Ltd., Kanagawa, Japan

[21] Appl. No.: 351,042

[22] Filed: Nov. 28, 1994

Related U.S. Application Data

[63] Continuation of Ser. No. 83,164, Jun. 29, 1993, abandoned.

[30] Foreign Application Priority Data

Jul. 6, 1992 [JP] Japan ..... 4-201949
Dec. 16, 1992 [JP] Japan ..... 4-353870

[51] Int. Cl.[6] ..... G03C 7/30

[52] U.S. Cl. ..... 430/357; 430/539; 430/545; 430/560; 430/604; 430/605; 430/642; 430/950

[58] Field of Search ..... 430/357, 539, 545, 560, 430/604, 605, 642, 950

[56] References Cited

U.S. PATENT DOCUMENTS 4,558,002 12/1985 Aotsuka ..... 430/538
5,079,136 1/1992 Tachibana et al. ..... 430/527
5,187,051 2/1993 Ishikawa ..... 430/950
5,238,788 8/1993 Kajiwara et al. ..... 430/950
5,244,776 9/1993 Kawai ..... 430/363

FOREIGN PATENT DOCUMENTS 2357929 2/1978 France .
4-15645 1/1992 Japan .
WO87/04534 7/1987 WIPO .

*Primary Examiner*—Hoa Van Le
*Attorney, Agent, or Firm*—Sughrue, Mion, Zinn, Macpeak & Seas

[57] ABSTRACT

There is disclosed a silver halide color photographic material and a method for forming a color image using said photographic material. The silver halide color photographic material comprises photosensitive emulsion layers each containing silver halide emulsion grains having 95 mol % or more of silver chloride and a hydrophilic colloid layer containing a white pigment that is applied between the support and the photosensitive emulsion layer nearest to the support, the weight ratio of the white pigment in said hydrophilic colloid layer being 40 wt % or more, and the ratio of the total amount of the hydrophilic colloid applied on the support to the total coating amount of the photosensitive silver halide in the photographic material being in the range from 5.0 to 30.0.

12 Claims, No Drawings

SILVER HALIDE COLOR PHOTOGRAPHIC MATERIAL AND METHOD FOR FORMING A COLOR IMAGE

This is a Continuation of application Ser. No. 08/083,164, filed Jun. 29, 1993, now abandoned.

FIELD OF THE INVENTION

The present invention relates to a silver halide color photographic material and a method for forming a color image using the same, and more specifically, relates to a silver halide color photographic material having a reflective layer, which photographic material has rapid processing ability and is excellent in sharpness and is improved in preservability thereof.

BACKGROUND OF THE INVENTION

In recent years, various electronic image-producing means have been developed and their image quality is compared with that of silver halide photographic materials. Such comparison has resulted in rediscovery of the merits in the high image quality and convenience of silver halide photographic materials. Therefore, the use of silver halide color photographic materials not only as a print of photography but also as a hard copy for electronic images has become considered. In such circumstances, in order to make conspicuous the features of silver halide photographic materials, studies, for example, of improving sharpness and color reproduction to obtain high image quality, and of shortening the processing time and improving the processing technique to render the process simple and rapid, are vigorously being pursued. In simple and rapid processing, owing to the progress of simple rapid development systems, typically mini-lab systems, high-image-quality printed photographs are now supplied relatively easily in a short period of time inexpensively. Further, by using a silver halide emulsion high in silver chloride content, as described in WO 87-04534, considerable shortening of the processing time and improvement of processing fluctuation are attained.

With respect to the color reproduction of high-image-quality photographic materials, color couplers excellent in color reproduction are now being developed and improved. On the other hand, as means of improving sharpness of silver halide photographic materials having a reflective support, various techniques are known. The techniques include, for example, (1) prevention of irradiation by using water-soluble dyes, (2) prevention of halation by using, for example, colloidal silver, mordant dyes, or solid fine particle dyes, and (3) increasing the filling ratio of the white pigment in the polyolefin laminate film on a paper support, or prevention of light from entering the support by applying additionally a white pigment in the form of a gelatin dispersion onto the support.

However, out of these means, the techniques (1) and (2) have such injurious effects that the sensitivity decreases considerably and that there is residual color at the time of processing. On the other hand, in the existing circumstances, increasing the filling ratio of the white pigment in the polyolefin laminate film on a paper support by the technique (3) is difficult in view of the production process of the laminate film. Accordingly, the additional application of a white pigment in the form of a gelatin dispersion onto the support is a preferable technique, because the sharpness can be improved considerably with minimal injurious effects. For example, JP-A ("JP-A" means unexamined published Japanese patent application) Nos. 64235/1982 and 187846/1987 and U.S. Pat. No. 4,558,002 disclose this technique. However, it was discovered that a new problem arose, in that the preservability of the photographic material is deteriorated when a white pigment in the form of a gelatin dispersion is applied. In addition, it was found that this problem is greater in the case of silver halide emulsion grains very high in silver chloride content, and improvement of this problem was required. Further, it was found that the higher the illuminance of the exposure is, the greater the change in the sensitivity during the storage is.

SUMMARY OF THE INVENTION

Accordingly, the object of the present invention is to provide a high-silver-chloride color photographic material that can provide a color photograph high in image quality inexpensively, which photograph is excellent in sharpness, high in sensitivity, and excellent in preservability.

Another object of the present invention is to provide a method for forming a color image that can provide a color photograph high in image quality inexpensively and rapidly.

The above and other objects, features, and advantages of the invention will become fully apparent in the following description.

DETAILED DESCRIPTION OF THE INVENTION

The above object is attained by providing a silver halide color photographic material having at least three photosensitive emulsion layers that are different in color sensitivity and each contains a different coupler capable of forming respectively yellow, magenta, and cyan colors, silver halide emulsion grains, and a hydrophilic colloid; and at least one hydrophilic colloid layer that is a nonphotosensitive layer, on a support; which comprises each of the photosensitive emulsion layers comprising silver halide emulsion grains having 95 mol % or more of silver chloride sensitized with gold and a hydrophilic colloid layer containing a white pigment that is applied between the support and the photosensitive emulsion layer nearest to the support, the weight ratio of the white pigment in said hydrophilic colloid layer being 40 wt % or more, and the ratio of the total amount ($g/m^2$) of the hydrophilic colloid (in terms of solids) applied on the support (on the side of the applied photosensitive emulsion layers) to the total coated amount ($g/m^2$) of the photosensitive silver halide (in terms of silver) in the photographic material being in the range from 5.0 or more to 30.0 or below.

As another embodiment of the present invention, there is provided a silver halide color photographic material having at least three photosensitive emulsion layers that are different in color sensitivity and contain couplers capable of forming respectively yellow, magenta, and cyan colors, silver halide emulsion grains, and a hydrophilic colloid; and at least one hydrophilic colloid layer that is a nonphotosensitive layer, on a support, which comprises each of the photosensitive emulsion layers comprising silver halide emulsion grains having 95 mol % or more of silver chloride and a hydrophilic colloid layer containing a white pigment in an amount of 2 $g/m^2$ that is applied between the support and the photosensitive emulsion layer nearest to the support, the ratio of the total amount ($g/m^2$) of the hydrophilic colloid (in terms of solids) applied on the support to the total coating amount ($g/m^2$) of the photosensitive silver halide (in terms of silver) in the photographic material being in the range from 5.0 to 30.0.

Further, the object of the present invention is more advantageously attained by a silver halide color photographic material as stated above, wherein gelatin having 800 ppm or less of calcium content is used in at least one of the photosensitive emulsion layers or nonphotosensitive layers.

Further, the object of the present invention is more advantageously attained by using a color image-forming process wherein the silver halide color photographic material is exposed to light by a scanning exposure system with the exposure time being $10^{-4}$ sec or less per picture element and then is color developed.

The present invention will now be described in detail below.

The application of a hydrophilic colloid layer containing a white pigment, which is a mode of the present invention, requires that the weight ratio of the white pigment is 40 wt % or more, preferably 50 wt % or more, and more preferably 70 wt % or more. There is no particular upper limit, but preferably the weight ratio is 99 wt % or below.

The term "weight ratio of white pigment" used in the specification and claims of the present invention means a ratio of amount ($g/m^2$) of white pigment, including the amount of various surface-active agents or dispersion stabilizers that are added to the pigment to improve, for example the dispersing ability, to the total amount of said hydrophilic colloid layer (including weights of white pigment, hydrophilic binder, and additives).

Although the amount ($g/m^2$) of the white pigment in the hydrophilic colloid layer containing the white pigment can arbitrarily be set in a range satisfying the above conditions, the white pigment is contained in an amount of 0.5 $g/m^2$ or more, preferably 1 $g/m^2$ or more, more preferably 2 $g/m^2$ or more. Although there is no particular upper limit, the amount is preferably 15 $g/m^2$ or less.

Although the thickness of the hydrophilic colloid layer containing the white pigment is determined based on the above content and the above coating amount, the thickness is preferably in the range of 0.5 to 10 $\mu$m, more preferably 1 to 5 $\mu$m.

As the white pigment used in the present invention, for example, titanium dioxide, barium sulfate, lithopone, alumina white, calcium carbonate, silica white, antimony trioxide, titanium phosphate, zinc oxide, white lead, and gypsum can be mentioned. Out of these pigments, titanium dioxide is particularly preferably used effectively. The titanium dioxide may be either of the rutile type or of the anatase type, which may be produced either by the sulfate process or by the chloride process.

The particle diameter of the white pigment particles used in the hydrophilic colloid layer is 0.1 to 1.0 $\mu$m, preferably 0.2 to 0.3 $\mu$m, on average.

In the present invention, as the binder (hydrophilic colloid) constituting the hydrophilic colloid layer containing a white pigment, the photosensitive silver halide emulsion layers, the nonphotosensitive intermediate layer, and the like, gelatin is preferably used. Further, gelatin having 800 ppm or less of calcium content is preferably used in at least one of photosensitive layers or nonphotosensitive layers. The calcium content of gelatin is preferably from 0 to 800 ppm, more preferably from 0 to 200 ppm. The average calcium content of gelatin is more preferred to be not greater than 800 ppm in a photographic constituting layer including photosensitive silver halide layers and nonphotosensitive layers. If necessary, in place of the gelatin, some other hydrophilic colloid can be used in an arbitrary ratio.

Examples of the other hydrophilic colloid include, for example, gelatin derivatives; graft polymers of gelatin with other polymers; proteins, such as albumin and casein; cellulose derivatives (e.g., hydroxyethyl cellulose, carboxymethyl cellulose, and cellulose sulfate); saccharides, such as starch derivatives; sodium alginate; and a wide variety of synthetic polymers, such as polyvinyl alcohols, partially acetalized polyvinyl alcohols, poly(N-vinylpyrrolidone)s, polyacrylic acids, polymethacrylic acids, polyacrylamides, polyvinylimidazoles, or polyvinylpyrazoles.

In the present invention, to the white-pigment-containing hydrophilic colloid layer, may be added, in addition to the white pigment and the binder, various materials that will be added to photographic materials. Examples are surface-active agents as coating aids, hardeners, dyes, or antifoggants. Further, high-boiling organic solvents in the form of finely dispersed oil droplets may be added. When a dispersion of a high-boiling organic solvent is added, preferably various oil-soluble materials (e.g., fluorescent brightening agents) are contained by being dissolved therein to be contained.

The photographic material of the present invention comprises a support; at least three photosensitive emulsion layers applied thereon; a nonphotosensitive layer, such as a color-mixing-inhibiting layer and a protective layer; and a hydrophilic colloid layer containing a white pigment.

In the present invention, the hydrophilic colloid layer containing a white pigment is applied between the support and the photosensitive emulsion layer.

It is sufficient if the hydrophilic colloid layer containing a white pigment in an amount of 2 $g/m^2$ or more is substantially nonphotosensitive. The term "substantially nonphotosensitive" means that the hydrophilic colloid layer containing a white pigment in an amount of 2 $g/m^2$ or more substantially does not contribute to the formation of an image.

As the support for use in the present invention, for example, papers made, for example, of natural pulp or synthetic pulp; baryta paper; papers coated with resins, such as polyolefins, e.g., polyethylenes and polypropylenes, or polyesters; films made of synthetic polymers, such as polyethylenes, polypropylenes, polystyrenes, polycarbonates, rigid PVC, and polyethylene terephthalates; and films made, for example, of natural polymers, such as cellulose diacetate, cellulose triacetate, or nitrocellulose; can be mentioned. With a view to making the development processing of the photographic material rapid, the support is preferably water-resistant. That is, preferably, a water-resistant resin-coated paper or a polymer film is used. A support having a diffused reflective surface of the second kind can be used. The term "diffused reflection of the second kind" means diffused reflection obtained by making a mirror surface uneven so that the mirror surface may be divided into fine mirror surfaces directed in different directions, and the directions of the divided fine surfaces (mirror surfaces) may be dispersed. The unevenness of the surface of the diffused reflective surface of the second kind is such that the three-dimensional average roughness to the central plane (central plane between the top of protuberances and the bottom of dents) is 0.1 to 2 μm, preferably 0.1 to 1.2 μm. The frequency of the unevenness on the surfaces is such that preferably the unevenness having a roughness of 0.1 μm or more have 0.1 to 2,000 cycles/mm, more preferably 50 to 600 cycles/mm. Details of such a support are described in JP-A No. 239244/1990.

In the present invention, a mode can be used wherein a white pigment is contained only in the white pigment-containing hydrophilic colloid layer, but is not contained in the resin constituting the support, such as the resin covering the paper support or the resin film of the support itself; or a mode can be used wherein a white pigment may be contained in, in addition to the white-pigment-containing hydrophilic colloid layer, the resin constituting the support.

In the present invention, if a reflective support is used, preferably the reflective support is a paper support those opposite surfaces are covered with water-resistant resin layers, at least one of which contains white pigment fine particles. Preferably the white pigment fine particles are contained at a density of 12 wt % or more, more preferably 14 wt % or more. It is recommended that the light-reflective white pigment particles are prepared by kneading a white pigment in the presence of a surface-active agent, and preferably use is made of a white pigment whose particle surface has been treated with a dihydric to a tetrahydric alcohol.

Preferably the white pigment fine particles are uniformly dispersed in the reflective layer without forming clusters or the like, and the magnitude of its distribution can be found by measuring the occupied area ratio (%) (Ri) of the fine particles projected on a unit area. The deviation coefficient of the occupied area ratio (%) can be found by the ratio s/R of the standard deviation s of Ri to the average value (R) of Ri. In the present invention, preferably the deviation coefficient of the occupied area ratio (%) of the fine particles of the pigment is 0.15 or less, more preferably 0.12 or less, and particularly preferably 0.08 or less.

Further, in these supports, the center-line surface roughness on the side to which the photosensitive layers are applied is preferably 0.14 μm or less.

In the present invention, a support having a diffused reflective surface of the second kind is preferably used.

On top of the hydrophilic colloid layer containing a white pigment, the photosensitive emulsion layers may be provided directly or with one or more nonphotosensitive hydrophilic colloid layers between them. If one or more nonphotosensitive hydrophilic colloid layers are provided, the total thickness of these layers is preferably 5 μm or less, more preferably 2 μm or less. These nonphotosensitive hydrophilic colloid layers may optionally contain various photographically useful substances. For example, a surface-active agent as a coating aid, a hardener, a dye, and an antifoggant can be contained. In that event, preferably, for example, colloidal silver, a dye dispersed in the solid state, or a dye fixed to a cationic polymer is contained to form a colored layer that can be decolored at the time of development processing. Alternatively, a high-boiling organic solvent that is dispersed in the form of fine oil droplets can be contained. The solvent can contain a photographically useful substance, such as an oil-soluble color-mix inhibitor, a fluorescent brightening agent, or an ultraviolet-absorbing agent, which will be dissolved in the solvent.

In the photographic material of the present invention, it is required that the ratio of the total amount ($g/m^2$) of the hydrophilic colloid (in terms of solid) applied on the support (on the side to which the photosensitive emulsion layers are applied) to the total coating amount ($g/m^2$) of the photosensitive silver halide in the photographic material (in terms of silver) is from 5.0 or more to 30.0 or less, more preferably from 10.0 or more to 25 or less, and most preferably 13.0 or more to 20.0 or less.

The expression "the total amount of the hydrophilic colloid applied on the support" means the weight ($g/m^2$) of the solids of the binder contained in the photosensitive silver halide emulsion layers, the nonphotosensitive intermediate layer, and the like, constituting the photographic material per unit area; generally the binder is gelatin, and if other hydrophilic colloid is used in place of or in combination with the gelatin, the expression "the total amount of the hydrophilic colloid applied on the support" means the weight of the sum of the solids of these hydrophilic colloids per unit area. The total amount of hydrophilic colloid on the support is preferably 2.0 to 25 $g/m^2$.

The expression "the total coating amount of the photosensitive silver halide ($g/m^2$ in terms of silver) in the photographic material" means the total weight ($g/m^2$) of the photosensitive silver halide emulsion grains contained in all the photographic emulsion layers constituting the photographic material in terms of silver per unit area. Therefore, silver that does not contribute to photosensitivity, such as black colloidal silver that will be applied to prevent halation and colloidal silver that will be used to serve as a filter, is not included in that weight. The total coating amount of photosensitive silver halide is preferably 0.030 to 1.0 $g/m^2$.

In the photographic material wherein, as in the present invention, a white pigment is applied between a support and a photosensitive layer and a high-silver-chloride emulsion having a silver chloride content of 95 mol % or more is used, if the above ratio is less than 5.0, the preservability of the photographic material will be deteriorated. On the other hand, if the ratio is over 30.0, the developing speed drops considerably and the color density obtained within a prescribed time changes, which fails to meet the object of the present invention of providing a color photograph high in image quality rapidly.

The color photographic material of the present invention can be formed by applying at least one yellow-color-forming silver halide emulsion layer, at least one magenta-color-forming silver halide emulsion layer, and at least one cyan-color-forming silver halide emulsion layer on a support having a reflective layer. In a common color photographic printing paper, by adding couplers capable of forming dyes having relationships complementary to lights to which the silver halide emulsions are sensitive, the color can be reproduced by the subtractive color process. A common color photographic printing paper can be formed in such a manner that silver halide emulsion grains are spectrally sensitized with a blue-sensitive spectral sensitizing dye, a green-sensitive spectral sensitizing dye, and a red-sensitive spectral sensitizing dye, in the order of the above color-forming layers, and they are applied on a support in the above-stated order. However, the order may be different. In view the rapid processing, there is a case wherein a photosensitive layer containing silver halide grains having the greatest average grain size is preferably the uppermost layer; or in view of the preservability under exposure to light, there is a case wherein the lowermost layer is preferably a magenta color-forming photosensitive layer.

The photosensitive layers and the hues that will be formed by color forming may be formed not to have the above correspondence, and at least one infrared photosensitive silver halide emulsion layer can be used.

In the present invention, it is required that, as the silver halide grains, silver chloride grains, silver bromochloride grains, or silver bromoiodochloride grains containing 95 mol % or more of silver chloride are used. Particularly, in the present invention, in order to shorten the development processing time, silver bromochloride grains or silver chloride grains substantially free from silver iodide can preferably be used. Herein the expression "substantially free from silver iodide" means that the silver iodide content is 1 mol % or less, preferably 0.2 mol % or less. On the other hand, for the purpose of increasing high-intensity sensitivity, spectral sensitization sensitivity, or long-term stability of the photographic material, there is a case wherein high-silver-chloride grains containing 0.01 to 3 mol % of silver iodide on the emulsion surface is preferably used as described in JP-A No. 84545/1991. Although the halogen composition of the emulsion may be different or uniform from grain to grain, when an emulsion having a halogen composition uniform from grain to grain is used, the properties of the grains can be easily made homogeneous. With respect to the halogen composition distribution in the silver halide emulsion grains, for example, grains having the so-called uniform-type structure, wherein the halogen composition is uniform throughout the grains; grains having the so-called layered-type structure, wherein the halogen composition of the core in the silver halide grains is different from that of the shell (consisting of a layer or layers) surrounding the core; or grains having a structure wherein non-layered parts different in halogen composition are present in the grains or on the surface of the grains (if the non-layered parts different in halogen composition are present on the surface of the grains, they may be joined to the edges, corners, or planes of grains) may suitably be chosen. To secure a high sensitivity, it is more advantageous to use one of the latter two than to use grains having a uniform-type structure and the latter two are also preferable in view of pressure-resistance properties. If the silver halide grains have the above structure, the boundary of parts different in halogen composition may be a clear boundary, an obscure boundary formed by a mixed crystal due to the difference of the composition, or a boundary wherein the structure is continuously changed positively.

In the high-silver-chloride emulsion for use in the present invention, preferably the silver bromide localized phase is layered or non-layered in the silver halide grains and/or on the surface of the grains as described above. The halogen composition of the above localized phase preferably has a silver bromide content of at least 10 mol %, more preferably the content is more than 20 mol %. The silver bromide content of the silver bromide localized layer can be analyzed, for example, by using the X-ray diffraction method (described, for example, in *Shin-jikkenkagaku-koza 6, Kozokaiseki*, edited by Nihonkagakukai, published by Maruzen). The localized phase may be present in the grains or on the edges, corners, or planes of the grains and one preferable example is one wherein the localized phase is grown epitaxially on the corners of the grains.

For the purpose of decreasing the replenishing amount of the development processing solution, it is effective to increase further the silver chloride content of the silver halide emulsion. In that case, an emulsion comprising nearly pure silver chloride, for example an emulsion having a silver chloride content of 98 to 100 mol %, is also preferably used.

The average grain size of the silver halide grains contained in the silver halide emulsion used in the present invention (the average grain size is calculated in such a way that, by assuming the diameters of circles equivalent to the projected areas of the grains to be the grain sizes, its number average is designated as the average grain size) is preferably 0.1 to 2 μm.

The grain size distribution of them is preferably a monodisperse distribution wherein the deviation coefficient (which is obtained by dividing the standard deviation of the grain size distribution by the average grain size) is preferably 20% or less, desirably 15% or less, and more preferably 10% or less. At that time, for the purpose of obtaining a wide latitude, it is also preferably carried out that such monodisperse emulsions are blended to be used in one layer or are applied in layers.

With respect to the form of the silver halide grains contained in the photographic emulsion, a regular crystal form, such as a cubic form, a tetradecahedral form, or an octahedral form, an irregular crystal form, such as a sphere form or a tabular form, or a composite of these can be used. Also a mixture of various crystal forms can be used. In the present invention, it is desired that, out of these, the above regular crystal form amounts to 50% or more, preferably 70% or more, and more preferably 90% or more, in the grains.

Besides these, an emulsion wherein tabular grains having an average aspect ratio (the diameter/thickness in terms of circles) of 5 or more, preferably 8 or more, amount to over 50% in all the grains in terms of projected areas can be preferably used.

The silver (bromo)chloride emulsion used in the present invention can be prepared by processes described, for example, by P. Glafkides in *Chimie et Phisique Photographique* (published by Paul Montel, 1967), by G. F. Duffin in *Photographic Emulsion Chemistry* (published by Focal Press, 1966), and by V. L. Zelikman et al. in *Making and Coating Photographic Emulsion* (published by Focal Press, 1964). That is, any of the acid process, the neutral process, the ammonia process, and the like can be used and to react a soluble silver salt with a soluble halide, any of the single-jet method, the double-jet method, a combination of these, and the like can be used. A method wherein grains are formed in an atmosphere of excess silver ions (so-called reverse precipitation method) can also be used. As one type of the reverse precipitation method, a method wherein the pAg in the liquid phase wherein the silver halide will be formed is kept constant, that is, the so-called controlled double-jet method can be used. According to this method, a silver halide emulsion wherein the crystal form is regular and the grain size is nearly uniform can be obtained.

The localized phase of the silver halide grains of the present invention or its substrate preferably contains different metal ions or their complex ions. Preferable metal ions are selected from ions of metals belonging to Groups VIII and IIb of the Periodic Table, their complex ions, lead ions, and thallium ions. Mainly, in the localized phase, ions selected from iridium ions, rhodium ions, and iron ions, and their complex ions, can be used; and mainly, in the substrate, ions of metals selected from osmium, iridium, rhodium, platinum, ruthenium, palladium, cobalt, nickel, iron, etc., and their complex ions can be used in combination. The localized phase and the substrate may be different in their kind of the metal ions and the concentration of the metal ions. Several of these metals can be used. Particularly, it is preferable to allow an iron compound and an iridium compound to be present in the silver bromide localized phase.

These metal-ion-providing compounds are incorporated in the localized phase of the silver halide grains of the present invention and/or some other grain part (substrate) at the time of the formation of silver halide grains by means, for example, of adding them into an aqueous gelatin solution, an aqueous halide solution, an aqueous silver salt solution, or other aqueous solution serving as a dispersing medium, or by adding silver halide fine grains already containing the metal ions and dissolving the fine grains.

The metal ions to be used in the present invention may be incorporated in emulsion grains before, during, or immediately after the formation of the grains, which time will be selected depending on their position in the grains.

Generally the silver halide emulsion used in the present invention is chemically and spectrally sensitized.

With respect to the chemical sensitization for the present invention, it is required to conduct at least one chemical sensitization with gold (gold sensitization). This gold sensitization can be used alone or in combination with a chemical sensitization, which uses a chalcogen sensitizer (specifically, sulfur sensitization, which typically includes the addition of an unstable sulfur compound; selenium sensitization, which uses a selenium compound; or tellurium sensitization, which uses a tellurium compound), or a reduction sensitization. With respect to compounds used in chemical sensitization, those described in JP-A No. 215272/1987, page 18 (the right lower column) to page 22 (the right upper column), are preferably used.

The emulsion used in the present invention is a so-called surface latent image-type emulsion, wherein a latent image is mainly formed on the grain surface.

To the silver halide emulsion used in the present invention, various compounds or their precursors can be added for the purpose of preventing fogging during the production process, storage, or the processing of the photographic material, or for the purpose of stabilizing the photographic performance. Specific examples of these compounds are described in the above-mentioned JP-A No. 215272/1987, pages 39 to 72, which compounds are preferably used. Further, 5-arylamino-1,2,3,4-thiatriazole compounds (whose aryl residues have at least one electron-attracting group respectively) described in EP 0447647 can also be preferably used.

The spectral sensitization is carried out for the purpose of spectrally sensitizing each emulsion layer of the present photosensitive material to a desired wavelength region of light.

In the photographic material of the present invention, as spectral sensitizing dyes used for spectral sensitization for blue, green, and red regions, for example, those described by F. M. Harmer in *Heterocyclic compounds-Cyanine dyes and related compounds* (published by John Wiley & Sons [New York, London], 1964) can be mentioned. As specific examples of the compounds and the spectral sensitization, those described in the above-mentioned JP-A No. 215272/1987, page 22 (the right upper column) to page 38, are preferably used. As the red-sensitive spectral sensitizing dyes for high-silver-chloride emulsion grains high in silver chloride content, spectral sensitizing dyes described in JP-A No. 123340/1991 are very preferable in view, for example, of the stability, the strength of the adsorption, and the temperature dependence of the exposure.

In the case wherein the photographic material of the present invention is to be spectral sensitized effectively in the infrared region, sensitizing dyes described in JP-A No. 15049/1991, page 12 (the left upper column) to page 21 (the left lower column); in JP-A No. 20 20730/1991, page 4 (the left lower column) to page 15 (the left lower column); in EP-0,420,011, page 4, line 21, to page 6, line 54; in EP-0,420,012, page 4, line 12, to page 10, line 33; in EP-0,443,466; and in U.S. Pat. No. 4,975,362 are preferably used.

To incorporate these spectral sensitizing dyes into the silver halide emulsion, they may be directly dispersed into the emulsion, or after they are dissolved in a solvent or a combination of solvents, such as water, methanol, ethanol, propanol, methyl Cellosolve, and 2,2,3,3-tetrafluoropropanol, the solution may be added to the emulsion. Also the spectral sensitizing dye may be formed together with an acid or a base into an aqueous solution, as described in JP-B ("JP-B" means examined Japanese patent publication) Nos. 23389/1969, 27555/1969, and 22089/1982, or the spectral sensitizing dye may be formed together with a surface-active agent into an aqueous solution or a colloid dispersion, as described in U.S. Pat. Nos. 3,822,135 and 4,006,025, and the obtained aqueous solution or colloid dispersion may be added to the emulsion. Also after the spectral sensitizing dye may be dissolved in a solvent substantially immiscible with water, such as phenoxyethanol, the solution is dispersed in water or a hydrophilic colloid and is added to the emulsion. The spectral sensitizing dye may be directly dispersed in a hydrophilic colloid, as described in JP-A Nos. 102733/1978 and 105141/1983, and the dispersion is added to the emulsion. The time at which the dispersion or solution is added to the emulsion may be at any stage of the preparation of the emulsion, which time is hitherto known and considered useful. That is, the dispersion or the solution may be added before or during the formation of grains of the silver halide emulsion, or during the period from immediately after the formation of grains till the washing step, or before or during the chemical sensitization, or during the period from immediately after the chemical sensitization till the cooling and solidifying of the emulsion, or at the time the coating solution is prepared. Although generally the addition of the dispersion or the solution is carried out in a period after the completion of the chemical sensitization and before the application, the dispersion or the solution may be added together with a chemical sensitizer to carry out spectral sensitization and chemical sensitization at the same time, as described in U.S. Pat. Nos. 3,628,969 and 4,225,666; or the addition may be carried out before chemical sensitization, as described in JP-A No. 113928/1983; or the dispersion or the solution may be added before the completion of the precipitation of the silver halide grains, to allow the spectral sensitization to start. Further, as taught in U.S. Pat. No. 4,225,666, it is possible that the spectrally sensitizing dye may be divided into two portions and added: one portion is added prior to chemical sensitization, and the other is added after the chemical sensitization. As shown in U.S. Pat. No. 4,183,756, the dispersion or the solution may be added at any time during the formation of silver halide grains. In particular, the sensitizing dye is preferably added before the washing step of the emulsion or before chemical sensitization of the emulsion.

The amount of these spectral sensitizing dyes to be added varies widely depending on the case and is preferably in the range of $0.5\times10^{-6}$ to $10\times10^{-2}$ mol, more preferably $1.0\times10^{-6}$ to $5.0\times10^{-3}$ mol, per mol of the silver halide.

In the present invention, if a sensitizing dye has spectral sensitization sensitivity particularly in from the red region to the infrared region, it is preferable to use additionally a compound described in JP-A No. 157749/1990, page 13 (the right upper column) to page 22 (the right lower column). By using these compounds, the preservability of the photographic material, the stability of the processing, and the supersensitizing effect can be increased specifically. In particular, additional use of compounds of general formulae (IV), (V), and (VI) in that patent is particularly preferable. These compounds are used in an amount of $0.5\times10^{-5}$ mol to $5.0\times10^{-2}$ mol, preferably $5.0\times10^{-5}$ mol to $5.0\times10^{-3}$ mol, per mol of the silver halide and the advantageous amount is in the range of 0.1 to 10,000, preferably 0.5 to 5,000, times one mol of the sensitizing dye.

The photosensitive material of the present invention is used in a print system using common negative printers, and also it is preferably used for digital scanning exposure that uses monochromatic high-density light, such as a second harmonic generating light source (SHG) that comprises a combination of a nonlinear optical crystal with a semiconductor laser or a solid state laser using a semiconductor laser as an excitation light source, a gas laser, a light-emitting diode, or a semiconductor laser. To make the system compact and inexpensive, it is preferable to use a semiconductor laser or a second harmonic generating light source (SHG) that comprises a combination of a nonlinear optical crystal with a semiconductor laser or a solid state laser. Particularly, to design an apparatus that is compact, inexpensive, long in life, and high in stability, the use of a semiconductor laser is preferable, and it is desired to use a semiconductor laser for at least one of the exposure light sources.

If such a scanning exposure light source is used, the spectral sensitivity maximum of the photographic material of the present invention can arbitrarily be set by the wavelength of the light source for the scanning exposure to be used. In an SHG light source obtained by combining a nonlinear optical crystal with a semiconductor laser or a solid state laser that uses a semiconductor laser as an excitation light source, since the emitting wavelength of the laser can be halved, blue light and green light can be obtained. Therefore, the spectral sensitivity maximum of the photographic material can be present in each of the blue region, the green region, and the red region. In order to use a semiconductor laser as a light source to make the apparatus inexpensive, high in stability, and compact, preferably each of at least two layers has a spectral sensitivity maximum at 670 nm or over. This is because the emitting wavelength range of the available, inexpensive, and stable III-V group semiconductor laser is present now only in from the red region to the infrared region. However, on the laboratory level, the oscillation of a II-VI group semiconductor laser in the green or blue region is confirmed and it is highly expected that these semiconductor lasers can be used inexpensively and stably if production technique for the semiconductor lasers is developed. In that event, the necessity that each of at least two layers has a spectral sensitivity maximum at 670 nm or over becomes lower.

In such scanning exposure, the time for which the silver halide in the photographic material is exposed is the time for which a certain very small area is required to be exposed. As the very small area, the minimum unit that controls the quantity of light from each digital data is generally used and is called a picture element. Therefore, the exposure time per picture element is changed depending on the size of the picture element. The size of the picture element is dependent on the density of the picture element, and the actual range is from 50 to 2,000 dpi. If the exposure time is defined as the time for which a picture size is exposed with the density of the picture element being 400 dpi, preferably the exposure time is $10^{-10}$ to $10^{-4}$ sec, more preferably $10^{-10}$ to $10^{-6}$ sec.

In the photographic material according to the present invention, for the purpose of preventing irradiation or halation or of improving, for example, safelight immunity, preferably a dye, which can be decolored by processing (in particular, an oxonol dye or a cyanine dye), as described in European Patent EP 0337490A2, pages 27 to 76, is added to the hydrophilic colloid layer. Herein, the term "be decolored by processing" means that being decolored any one of processing including development, bleaching, fixing (or bleach/fixing), and water-washing, or being decolored at all the processings above-mentioned.

Some of these water-soluble dyes deteriorate the color separation or the safelight immunity if the amount thereof to be used is increased. As a dye that can be used without deteriorating the color separation, a water-soluble dye described in Japanese Patent Application No. 310143/1991, 310189/1991, or 310139/1991 is preferable.

In the present invention, instead of or in combination with the water-soluble dye, a colored layer capable of being decolored by processing is used. The colored layer used that can be decolored by processing may be arranged in contact with the emulsion layer directly or through an intermediate layer containing a processing color-mix inhibitor, such as gelatin and hydroquinone. This colored layer is preferably located under the emulsion layer (on the side of the support) that will form a primary color which is the same as that of the colored layer. Colored layers corresponding to respective primary colors may all be arranged, or only some of them may be arbitrarily selected and arranged. A colored layer that has been colored to correspond to several primary color regions can also be arranged. The optical reflection density of the colored layer is preferably such that the value of the optical density at the wavelength at which the optical density is highest in the wavelength region used for the exposure (in the visible light region of 400 nm to 700 nm in a usual printer exposure and in the wavelength of the scanning exposure light source to be used in the case of scanning exposure) is 0.2 or higher but 3.0 or lower, more preferably 0.5 or higher but 2.5 or lower, and particularly preferably 0.8 or higher but 2.0 or lower.

To form the colored layer, conventionally known methods can be applied. For instance, a method wherein a dye described in JP-A No. 282244/1990, page 3 (the right upper column) to page 8, or a dye described in JP-A No. 7931/1991, page 3 (the right upper column) to page 11 (the left lower column), is brought into the form of a solid fine particle dispersion and is allowed to be contained in a hydrophilic colloid layer; a method wherein an anionic dye is fixed to a cationic polymer; a method wherein a dye is adsorbed to fine particles, for example, of a silver halide and is fixed into a layer; or a method wherein colloidal silver is used as described in JP-A No. 239544/1989; can be mentioned. As the method for dispersing a fine powder of a dye in the solid state, for example, a method is described in JP-A No. 308244/1990, pages 4 to 13, wherein a fine powder dye, which is substantially insoluble in water at a pH of at least 6 or below, but which is substantially soluble in water at a pH of at least 8, is incorporated. Further, a method wherein an anionic dye is fixed to a cationic polymer is-described in JP-A No. 84637/1990, pages 18 to 26. Methods for preparing colloidal silver as a light-absorbing agent are described in U.S. Pat. Nos. 2,688,601 and 3,459,563. Out of these methods, the method wherein a fine powder dye is incorporated, and the method wherein colloidal silver is used, are preferred.

As a binder or protective colloid that can be used in the photographic material according to the present invention, gelatin is advantageously used, but some other hydrophilic colloid can be used alone or in combination with gelatin. As a gelatin, preferably low-calcium gelatin having a calcium content of 800 ppm or less, more preferably 200 ppm or less, is used. In order to prevent various fungi or bacteria from propagating in the hydrophilic colloid layer to deteriorate the image quality, preferably a mildew-proofing agent, as described in JP-A No. 271247/1988, is added.

When the photographic material of the present invention is subjected to printer exposure, preferably a band strip filter described in U.S. Pat. No. 4,880,726 is used. Thus, light color mixing is eliminated and color reproduction is remarkably improved.

An exposed photographic material can be subjected to conventional color development processing, and, in the case of the color photographic material of the present invention, to make the processing rapid, preferably after it is color-developed, it is bleach-fixed. Particularly, when the above high-silver-chloride emulsion is used, the pH of the bleach-fix solution is preferably about 6.5 or below, more preferably 6 or below, for the purpose, for example, of accelerating desilvering.

As the silver halide emulsion to be applied to the photographic material of the present invention and the other materials (e.g., additives) and the photographic constitutional layers (including the arrangement of the layers) to be applied thereto and the processing method and additives used in the processing of the photographic material of the present invention, those described in the below-mentioned patent gazettes, particularly in European Patent EP 0,355,660A2 (JP-A No. 139544/1990), are preferably used.

| Element constituting photographic material | JP-A No. 215272/1987 | JP-A No. 33144/1990 | EP 0,355,660A2 |
|---|---|---|---|
| Silver halide emulsion | p. 10 upper right column line 6 to p. 12 lower left column line 5, and p. 12 lower right column line 4 from the bottom to p. 13 upper left column line 17 | p. 28 upper right column line 16 to p. 29 lower right column line 11 and p. 30 lines 2 to 5 | p. 45 line 53 to p. 47 line 3 and p. 47 lines 20 to 22 |
| Solvent for silver halide | p. 12 lower left column line 6 to 14 and p. 13 upper left column line 3 from the bottom to p. 18 lower left column last line | — | — |
| Chemical sensitizing agent | p. 12 lower left column line 3 from the bottom to lower right column line 5 from the bottom and p. 18 lower right column line 1 to p. 22 upper right column line 9 from the bottom | p. 29 lower right column line 12 to last line | p. 47 lines 4 to 9 |
| Spectral sensitizing agent (method) | p. 22 upper right column line 8 from the bottom to p. 38 last line | p. 30 upper left column lines 1 to 13 | p. 47 lines 10 to 15 |
| Emulsion stabilizer | p. 39 upper left column line 1 to p. 72 upper right column last line | p. 30 upper left column line 14 to upper right column line 1 | p. 47 lines 16 to 19 |
| Developing accelerator | p. 72 lower left column line 1 to p. 91 upper right column line 3 | — | — |
| Color coupler (Cyan, Magenta, and Yellow coupler) | p. 91 upper right column line 4 to p. 121 upper left column line 6 | p. 3 upper right column line 14 to p. 18 upper left column last line and p. 30 upper right column line 6 to p. 35 lower right column line 11 | p. 4 lines 15 to 27, p. 5 line 30 to p. 28 last line, p. 45 lines 29 to 31 and p. 47 line 23 to p. 63 line 50 |
| Color Formation-strengthen agent | p. 121 upper left column line 7 to p. 125 upper right column line 1 | — | — |
| Ultraviolet absorbing agent | p. 125 upper right column line 2 to p. 127 lower left column last line | p. 37 lower right column line 14 to p. 38 upper left column line 11 | p. 65 lines 22 to 31 |
| Discoloration inhibitor | p. 127 lower right column line 1 to p. 137 lower | p. 36 upper right column line 12 to p. 37 upper | p. 4 line 30 to p. 5 line 23, |

-continued

| Element constituting photographic material | JP-A No. 215272/1987 | JP-A No. 33144/1990 | EP 0,355,660A2 |
|---|---|---|---|
| (Image-dye stabilizer) | left column line 8 | left column line 19 | p. 29 line 1 to p. 45 line 25 p. 45 lines 33 to 40 and p. 65 lines 2 to 21 |
| High-boiling and/or low-boiling solvent | p. 137 lower left column line 9 to p. 144 upper right column last line | p. 35 lower right column line 14 to p. 36 upper left column line 4 | p. 64 lines 1 to 51 |
| Method for dispersing additives for photograph | p. 144 lower left column line 1 to p. 146 upper right column line 7 | p. 27 lower right column line 10 to p. 28 upper left column last line and p. 35 lower right column line 12 to p. 36 upper right column line 7 | p. 63 line 51 to p. 64 line 56 |
| Film Hardener | p. 146 upper right column line 8 to p. 155 lower left column line 4 | — | — |
| Developing Agent precursor | p. 155 lower left column line 5 to p. 155 lower right column line 2 | — | — |
| Compound releasing development inhibitor | p. 155 lower right column lines 3 to 9 | — | — |
| Support | p. 155 lower right column line 19 to p. 156 upper left column line 14 | p. 38 upper right column line 18 to p. 39 upper left column line 3 | p. 66 line 29 to p. 67 line 13 |
| Constitution of photosensitive layer | p. 156 upper left column line 15 to p. 156 lower right column line 14 | p. 28 upper right column lines 1 to 15 | p. 45 lines 41 to 52 |
| Dye | p. 156 lower right column line 15 to p. 184 lower right column last line | p. 38 upper left column line 12 to upper right column line 7 | p. 66 lines 18 to 22 |
| Color-mix inhibitor | p. 185 upper left column line 1 to p. 188 lower right column line 3 | p. 36 upper right column lines 8 to 11 | p. 64 line 57 to p. 65 line 1 |
| Gradation controller | P.188 lower right column lines 4 to 8 | — | — |
| Stain inhibitor | p. 188 lower right column line 9 to p. 193 lower right column line 10 | p. 37 upper left column last line to lower right column line 13 | p. 65 line 32 to p. 66 line 17 |
| Surface-active agent | p. 201 lower left column line 1 to p. 210 upper right column last line | p. 18 upper right column line 1 to p. 24 lower right column last line and p. 27 lower left column line 10 from the bottom to lower right column line 9 | — |
| Fluorine-containing agent (As Antistatic agent, coating aid, lubricant, adhesion inhibitor, or the like) | p. 210 lower left column line 1 to p. 222 lower left column line 5 | p. 25 upper left column line 1 to p. 27 lower right column line 9 | — |
| Binder (Hydrophilic colloid) | p. 222 lower left column line 6 to p. 225 upper left column last line | p. 38 upper right column lines 8 to 18 | p. 66 lines 23 to 28 |
| Thickening agent | p. 225 upper right column line 1 to p. 227 upper right column line 2 | — | — |
| Antistatic agent | p. 227 upper right column line to p. 230 upper left column line 1 | — | — |
| Polymer latex | P.230 upper left column line 2 to p. 239 last line | — | — |
| Matting agent | p. 240 upper left column line 1 to p. 240 upper right column last line | — | — |
| Photographic processing method (processing process, additive, etc.) | p. 3 upper right column line 7 to p. 10 upper right column line 5 | p. 39 upper left column line 4 to p. 42 upper left column last line | p. 67 line 14 to p. 69 line 28 |

Note:
In the cited part of JP-A No. 215272/1987, amendment filed on March 16, 1987 is included. Further, among the above-mentioned couplers, it is preferred to use so called short wavelength-type yellow coupler, described in JP-A Nos. 231451/1988, 123047/1988, 241547/1988, 73499/1989, 213648/1989, and 250944/1989, as a yellow coupler.

Preferably, the cyan, magenta, and yellow couplers are impregnated into loadable latex polymers (e.g., loadable latex polymers described in U.S. Pat. No. 4,203,716) in the presence or absence of a high-boiling organic solvent listed in the above table, or they are dissolved together with water-insoluble and organic solvent-soluble polymers and are emulsified and dispersed into hydrophilic colloid aqueous solution. As water-insoluble and organic solvent-soluble polymers that can be preferably used, homopolymers or copolymers described in U.S. Pat. No. 4,857,449, the seventh column to the fifteenth column, and in International Publication No. WO 88/00723, pages 12 to 30, can be mentioned. More preferably, methacrylate-type polymers or acrylamide-type polymers, particularly acrylamide-type polymers, are used in view of color image stability and the like.

In the photographic material according to the present invention, color image preservability improving compounds as described in European Patent EP 0277589A2 are preferably used together with couplers, particularly, together with pyrazoloazole couplers and pyrrolotriazole couplers.

That is, the use of a compound described in the above-mentioned patent specifications that combines with the aromatic amine developing agent remaining after the color development processing to form a chemically inactive and substantially colorless compound and/or a compound described in the above-mentioned patent specifications that combines with the oxidized product of the aromatic amine color developing agent remaining after the color development processing to form a chemically inactive and substantially colorless compound simultaneously or singly is preferable, because, for example, the occurrence of stain or other side effects due to the formation of color formed dyes by the reaction of the color developing agent or its oxidized product remaining in the film during the storage after the processing with couplers can be prevented.

Further, as the cyan couplers, in addition to diphenylimidazole cyan couplers described in JP-A No. 33144/1990, 3-hydroxypyridine cyan couplers described in European Patent EP 0333185A2 (particularly, that formed by attaching a chlorine coupling-off group to the 4-equivalent coupler of Coupler (42) to make it to be 2-equivalent and Couplers (6) and (9) which are listed as specific examples are preferable), cyclic active methylene cyan couplers described in JP-A No. 32260/1989 (particularly Coupler Examples 3, 8, and 34 that are listed as specific examples are preferable), pyrrolopyrazole cyan couplers described in European Patent EP 0456226 A1, pyrroloimidazole cyan couplers described in European Patent EP 0484909, and pyrrolotirazole cyan couplers described in European Patents EP 0488248 and EP 491197A1 are preferably used. Among them, pyrrolotriazole cyan couplers are particularly preferably used.

As the yellow couplers, in addition to the compounds listed in the above table, acylacetamide yellow couplers whose acyl group has a 3- to 5-membered cyclic structure described in European Patent EP 0447969A1, malondianilide yellow coupler having a cyclic structure described in European Patent EP 0482552A1, and acylacetamide yellow couplers having a dioxane structure described in U.S. Pat. No. 5,118,599 are preferably used. Among them, acylacetamide yellow couplers whose acyl group is a 1-alkylcyclopropane-1-carbonyl group and malondianilide yellow couplers wherein one of the anilide constitutes an indoline ring are preferably used. These couplers can be used alone or in combination.

As the magenta couplers used in the present invention, 5-pyrazolone magenta couplers and pyrazoloazole magenta couplers as described in the known literature shown in the above table are used, but in particular, in view, for example, of the hue, the stability of images, and the color forming properties, pyrazolotriazole couplers wherein a secondary or tertiary alkyl group is bonded directly to the 2-, 3-, or 6-position of the pyrazolotriazole ring as described in JP-A No. 65245/1986, pyrazoloazole couplers containing a sulfonamido group in the molecule as described in JP-A No. 65246/1986, pyrazoloazole couplers having an alkoxyphenylsulfonamido ballasting group as described in JP-A No. 147254/1986, and pyrazoloazole couplers having an alkoxy group or an aryloxy group in the 6-position as described in European Patent Nos. 226,849A and 294,785A are preferably used.

As the method for processing the color photographic material of the present invention, in addition to the methods listed in the above table, processing materials and processing methods described in JP-A No. 207250/1990, page 26 (the right lower column, line 1) to page 34 (the right upper column, line 9) and JP-A No. 97355/1992, page 5 (the left upper column, line 17) to page 18 (the right lower column, line 20) are preferable.

The silver halide color photographic material of the present invention exhibits the excellent effect that give a color photograph high in quality and excellent in sharpness. The color photographic material of the present invention is excellent in preservability. Further, according to the color image forming method of the present invention, a color photograph high in image quality can be provided inexpensively and rapidly.

Next, the present invention will be described in detail in accordance with examples.

EXAMPLE 1

(Preparation of photographic material)

A multilayer color print paper (I) having layer compositions shown below was prepared by coating various photographic constituting layers on a paper support laminated on both sides thereof with polyethylene film, followed by subjecting to a corona discharge treatment on the surface thereof and provided a gelatin prime coat layer containing sodium dodecylbenzene sulfonate. Coating solutions were prepared as follows:

Preparation of the first layer coating solution 153.0 Grams of yellow coupler (ExY), 15.0 g of image-dye stabilizer (Cpd-1), 7.5 g of image-dye stabilizer (Cpd-2), 16.0 g of image-dye stabilizer (Cpd-3) were dissolved in 25 g of solvent (Solv-1), 25 g of solvent (Solv-2), and 180 ml of ethyl acetate, and the resulting solution was dispersed and emulsified in 1,000 ml of 10% aqueous gelatin solution containing 60 ml of 10% sodium dodecylbenzenesulfonate solution and 10 g of citric acid, thereby prepared emulsified dispersion A. Separately silver chlorobromide emulsion A-1 (cubic grains, 3:7 (silver mol ratio) blend of large size emulsion having 0.88 μm of average grain size and small size emulsion having 0.70 μm of average grain size, and 0.08 and 0.10 of deviation coefficient of grain size distribution, respectively, each in which 0.3 mol % of silver bromide was located at a part of grain surface; and at the inner side of grains and in the silver bromide-localized layer 0.2 mg of potassium hexachloroiridate (IV) and 1 mg of potassium ferrocyanide, each in total amount, were contained) was prepared. Blue-sensitive sensitizing dyes A and B, shown below, were added in amounts of dyes that corresponds to $2.0\times10^{-4}$ mol and $2.5\times10^{-4}$ mol to the large size emulsion and small size emulsion, per mol of silver, respectively, and then the chemical sensitizing of this emulsion was carried out optimumly by adding $1\times10^{-5}$ mol/mol of Ag of sulfur sensitizing agent (triethyl thiourea) and $1\times10^{-5}$ of gold sensitizing agent (chloroauric acid) in the presence of nucleic acid decomposed product (0.2 g/mol of Ag) at pH 6.7 and pAG 7.0. The above-described emulsified dispersion A and this silver chlorobromide emulsion A-1 were mixed together and dissolved to give the composition shown below, thereby preparing the first layer coating solution.

Coating solutions for the second to seventh layers were also prepared in the same manner as the coating solution of first layer. As a gelatin hardener for the respective layers, 1-oxy-3,5-dichloro-s-triazine sodium salt was used.

Further, Cpd-14 and Cpd-15 were added in each layer in such amounts that the respective total amount becomes 25.0 mg/m$^2$ and 50.0 mg/m$^2$.

Silver chlorobromide emulsion in each photosensitive emulsion layer was controlled in size of grains and in silver halide composition, in the same manner as the above described silver chlorobromide emulsion A-1, and spectral sensitizing dyes shown below were used in respective layers, thereby preparing each emulsion having content shown in Table 1.

Blue-sensitive emulsion layer:

Sensitizing dye A

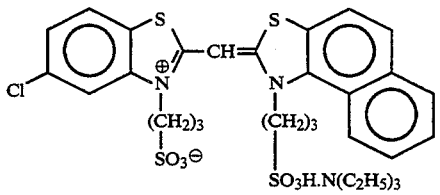

and

-continued

Sensitizing dye B

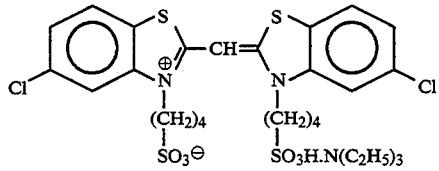

(each $2.0\times10^{-4}$ mol to the large size emulsion and $2.5\times10^{-4}$ mol to the small size emulsion, per mol of silver halide.)

Green-sensitive emulsion layer:

Sensitizing dye C

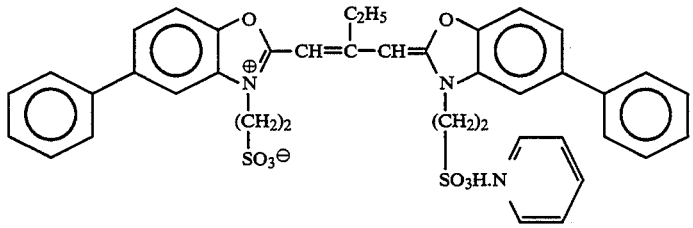

($4.0\times10^{-4}$ mol to the large size emulsion and $5.6\times10^{-4}$ mol to the small size emulsion, per mol of silver halide) and Sensitizing dye D

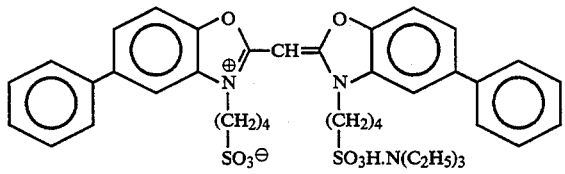

($7.0\times10^{-5}$ mol to the large size emulsion and $1.0\times10^{-5}$ mol to the small size emulsion, per mol of silver halide)

Red-sensitive emulsion layer:

Sensitizing dye E

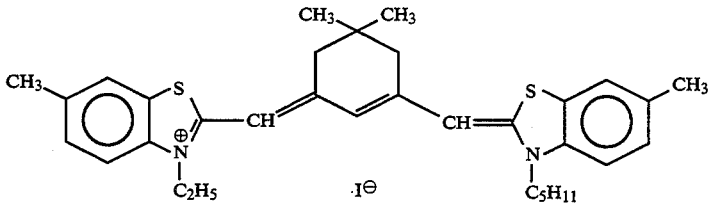

($0.9\times10^{-4}$ mol to the large size emulsion and $1.1\times10^{-4}$ mol to the small size emulsion, per mol of silver halide)

To the red-sensitive emulsion layer, the following compound was added in an amount of $2.6\times10^{-3}$ mol per mol of silver halide:

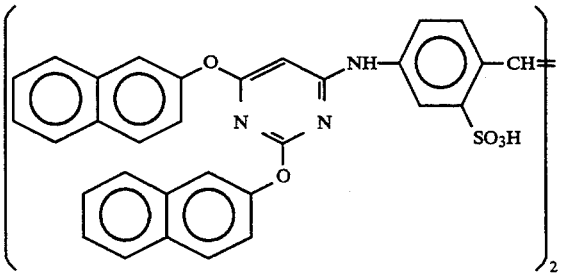

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.0\times10^{-4}$ mol, and $2.5\times10^{-4}$ mol, per mol of silver halide, respectively.

Further, 4-hydroxy-6-methyl-1,3,3a,7-tetrazaindene was added to the blue-sensitive emulsion layer and the green-sensitive emulsion layer in amount of $1\times10^{-4}$ mol and $2\times10^{-4}$ mol, per mol of silver halide, respectively.

The dyes shown below (figure in parentheses represents coating amount) were added to the emulsion layers for prevention of irradiation.

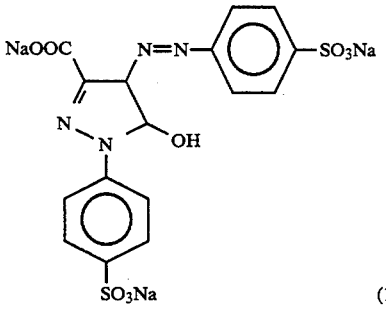

(10 mg/m²)

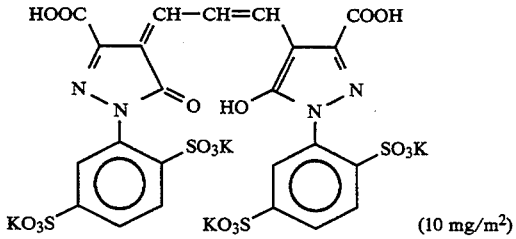

(10 mg/m²)

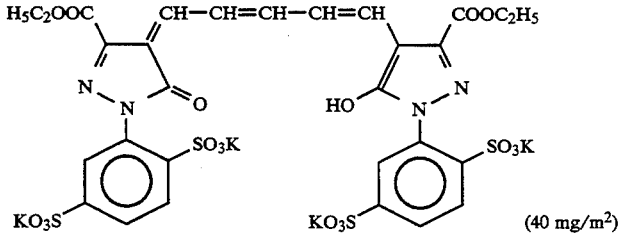

(40 mg/m²)

and

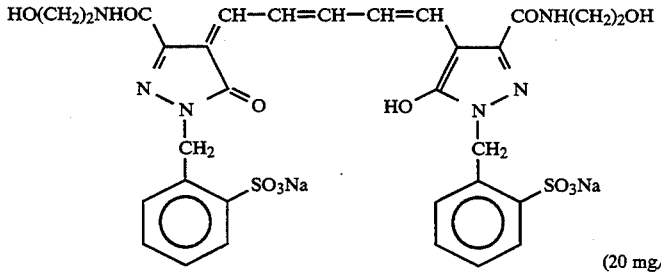

(20 mg/m²)

TABLE 1

| Emulsion | Composition of halide (mol %) | Particle size & blend ratio | Spectral sensitizing dye used | Chemical sensitizing |
|---|---|---|---|---|
| Blue-sensitive emulsion layer | | | | |
| A - 1 | AgBrCl (Br = 0.3) | 0.88 μm/0.70 μm 3:7 | Sensitizing dyes A/B | Gold & Sulfur |
| A - 2 | AgBrCl (Br = 10) | 0.85 μm/0.66 μm 3:7 | Sensitizing dyes A/B | " |

TABLE 1-continued

| Emulsion | Composition of halide (mol %) | Particle size & blend ratio | Spectral sensitizing dye used | Chemical sensitizing |
|---|---|---|---|---|
| A - 3 | AgBrCl (Br = 70) | 0.85 μm/0.66 μm 3:7 | Sensitizing dyes A/B | " |
| A - 4 | AgBrCl (Br = 0.3) | 0.85 μm/0.70 μm 3:7 | Sensitizing dyes A/B | Sulfur |
| Green-sensitive emulsion layer | | | | |
| B - 1 | AgBrCl (Br = 0.8) | 0.55 μm/0.39 μm 1:3 | Sensitizing dyes C/D | Gold & Sulfur |
| B - 2 | AgBrCl (Br = 10) | 0.54 μm/0.38 μm 1:3 | Sensitizing dyes C/D | " |
| B - 3 | AgBrCl (Br = 70) | 0.54 μm/0.38 μm 1:3 | Sensitizing dyes C/D | " |
| B - 4 | AgBrCl (Br = 0.8) | 0.55 μm/0.39 μm 1:3 | Sensitizing dyes C/D | Sulfur |
| Red-sensitive emulsion layer | | | | |
| C - 1 | AgBrCl (Br = 0.8) | 0.50 μm/0.41 μm 1:4 | Sensitizing dye E | Gold & Sulfur |
| C - 2 | AgBrCl (Br = 10) | 0.50 μm/0.40 μm 1:4 | Sensitizing dye E | " |
| C - 3 | AgBrCl (Br = 70) | 0.50 μm/0.40 μm 1:4 | Sensitizing dye E | " |
| C - 4 | AgBrCl (Br = 0.8) | 0.50 μm/0.41 μm 1:4 | Sensitizing dye E | Sulfur |

(Composition of Layers)

The composition of each layer is shown below. The figures represent coating amount (g/m2). The coating amount of each silver halide emulsion is given in terms of silver.

| Supporting Base: Paper laminated polyethylene (a white pigment, $TiO_2$, and a bluish dye, ultramarine, were included in the first layer side of the polyethylene-laminated film) | |
|---|---|
| First Layer (Blue-sensitive emulsion layer) | |
| The above described silver chlorobromide emulsion A-1 | 0.27 |
| Gelatin | 1.26 |
| Yellow coupler (ExY) | 0.79 |
| Image-dye stabilizer (Cpd-1) | 0.08 |
| Image-dye stabilizer (Cpd-2) | 0.04 |
| Image dye stabilizer (Cpd-3) | 0.08 |
| Solvent (Solv-1) | 0.13 |
| Solvent (Solv-2) | 0.13 |
| Second Layer (Color-mix preventing layer) | |
| Gelatin | 0.80 |
| Color mix inhibitor (Cpd-4) | 0.06 |
| Solvent (Solv-7) | 0.03 |
| Solvent (Solv-2) | 0.25 |
| Solvent (Solv-3) | 0.25 |
| Third Layer (Green-sensitive emulsion layer) | |
| Silver chlorobromide emulsion B (cubic grains, 1:3 (Ag mol ratio) blend of large size emulsion having average grain size of 0.55 μm and small size emulsion having average grain size of 0.39 μm, whose deviation coefficient of grain size distribution is 0.10 and 0.08, respectively, each in which emulsion 0.8 mol % of silver bromide was located at a part of grain surface; at the inner side of grains and in the silver bromide-localized layer 0.2 mg of potassium hexachloroiridate (IV) and 1 mg of potassium ferrocyanide, each in total amount, were contained; and the chemical sensitizing of the emulsion was carried out optimumly by adding the same sulfur sensitizing agent and gold sensitizing agent as used in the first layer coating solution in the presence of nucleic acid decomposed product) | 0.13 |
| Gelatin | 1.40 |
| Magenta coupler (ExM) | 0.16 |
| Image-dye stabilizer (Cpd-5) | 0.15 |
| Image-dye stabilizer (Cpd-2) | 0.03 |
| Image-dye stabilizer (Cpd-6) | 0.01 |
| Image-dye stabilizer (Cpd-7) | 0.01 |
| Image-dye stabilizer (Cpd-8) | 0.08 |
| Solvent (Solv-3) | 0.50 |
| Solvent (Solv-4) | 0.15 |
| Solvent (Solv-5) | 0.15 |
| Fourth Layer (Color-mix preventing layer) | |
| Gelatin | 0.65 |
| Color-mix inhibitor (Cpd-4) | 0.04 |
| Solvent (Solv-7) | 0.02 |
| Solvent (Solv-2) | 0.18 |
| Solvent (Solv-3) | 0.18 |
| Fifth Layer (Red-sensitive emulsion layer) | |
| Silver chlorobromide emulsion C (cubic grains, 1:4 (Ag mol ratio) blend of large size emulsion having average grain size of 0.50 μm and small size emulsion having average grain size of 0.41 μm, whose deviation coefficient of grain size distribution is 0.09 and 0.11, respectively, each in which emulsion 0.8 mol % of silver bromide was located at a part of grain surface; at the inner side of grains and in the silver bromide-localized layer 0.2 mg of potassium hexachloro-iridate (IV) and 1.2 mg of potassium ferrocyanide, each in total amount, were contained; and the chemical sensitizing of the emulsion was carried out optimumly by adding the same sulfur sensitizing agent and gold sensitizing agent as used in the first layer coating solution in the presence of nucleic acid decomposed product) | 0.20 |
| Gelatin | 0.80 |
| Cyan coupler (ExC) | 0.33 |
| Ultraviolet absorber (UV-2) | 0.18 |
| Image-dye stabilizer (Cpd-1) | 0.33 |

-continued

| | |
|---|---|
| Image-dye stabilizer (Cpd-6) | 0.01 |
| Image-dye stabilizer (Cpd-8) | 0.01 |
| Image-dye stabilizer (Cpd-9) | 0.01 |
| Image-dye stabilizer (Cpd-10) | 0.01 |
| Image-dye stabilizer (Cpd-11) | 0.01 |
| Solvent (Solv-1) | 0.01 |
| Solvent (Solv-6) | 0.22 |
| Sixth Layer (Ultraviolet absorbing layer) | |
| Gelatin | 0.50 |
| Ultraviolet absorber (UV-1) | 0.38 |
| Image-dye stabilizer (Cpd-5) | 0.02 |
| Image-dye stabilizer (Cpd-12) | 0.15 |
| Seventh Layer (Protective layer) | |
| Gelatin | 1.10 |
| Acryl-modified copolymer of polyvinyl alcohol (modification degree: 17%) | 0.05 |
| Liquid paraffin | 0.02 |
| Image-dye stabilizer (Cpd-13) | 0.01 |

(ExY) Yellow coupler
Mixture ((a):(b) = 1:1 in molar ratio) of (a) R = 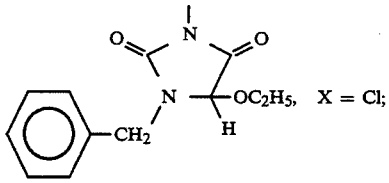

(b) R = 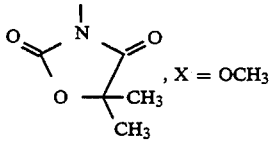

of the following formula

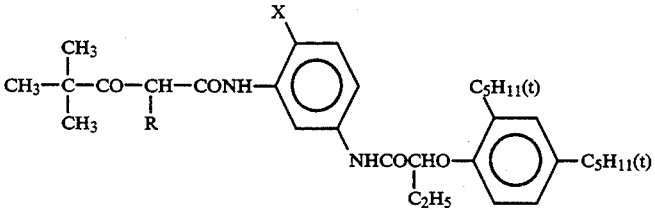

(ExM) Magenta coupler

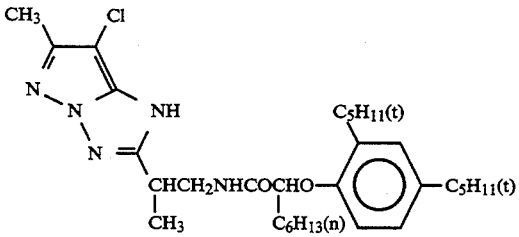

(ExC) Cyan coupler
Mixture (3:7 in molar ratio) of

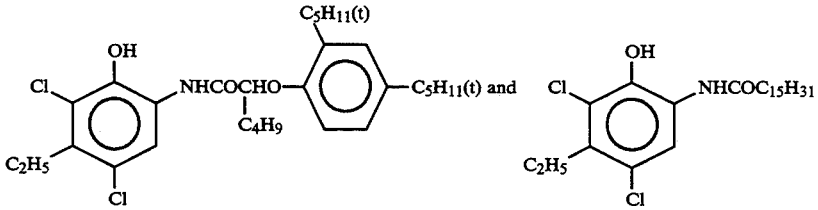

(Cpd-1) Image-dye stabilizer

-continued
$$\left(CH_2-\underset{\substack{|\\ CONHC_4H_9(t)}}{CH}\right)_n$$
Av. molecular weight: 60,000
(Cpd-2) Image-dye stabilizer
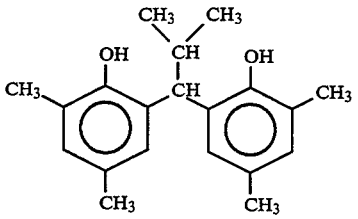
(Cpd-3) Image-dye stabilizer
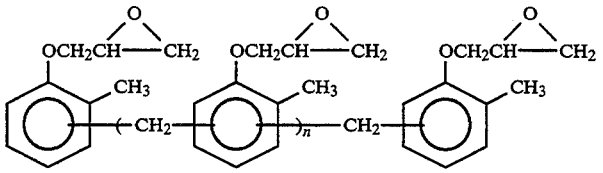
n = 7–8 (in average)
(Cpd-4) Color-mix inhibitor
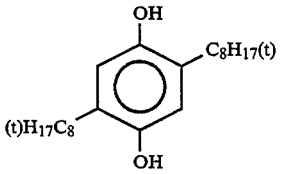
(Cpd-5) Image-dye stabilizer
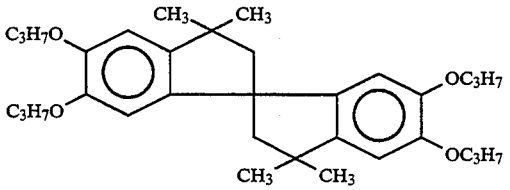
(Cpd-6) Image-dye stabilizer
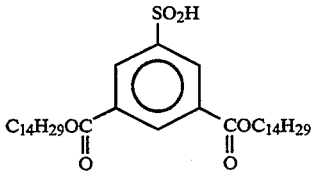
(Cpd-7) Image-dye stabilizer
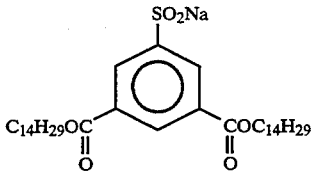
(Cpd-8) Image-dye stabilizer -continued
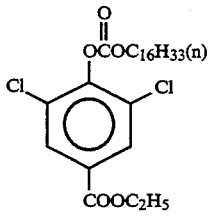
(Cpd-9) Image-dye stabilizer
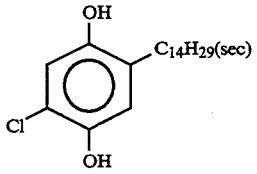
(Cpd-10) Image-dye stabilizer
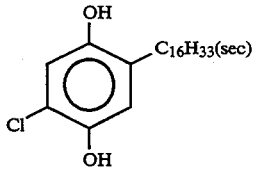
(Cpd-11) Image-dye stabilizer
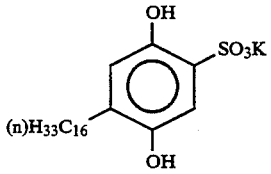
(Cpd-12) Image-dye stabilizer
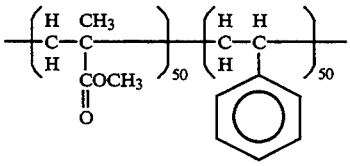
Av. molecular weight: 60,000
(Cpd-13) Image-dye stabilizer
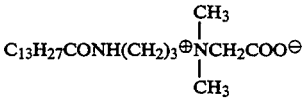
(Cpd-14) Antiseptic
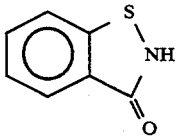
(Cpd-15) Antiseptic
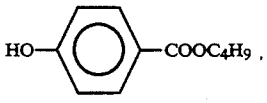

-continued
(UV-1) Ultraviolet ray absorber
Mixture of (i), (ii), (iii), and (iv) (1:5:10:5 in weight ratio)
(i) 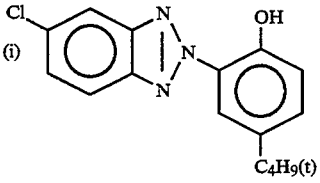
, (ii) 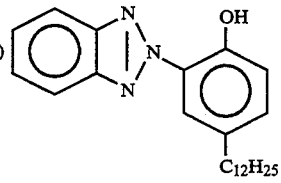
,
(iii) 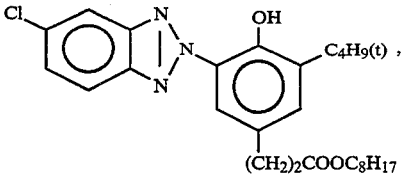
, and
(iv) 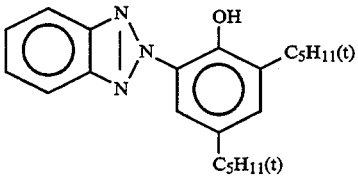
(UV-2) Ultraviolet ray absorber
Mixture of (v), (vi), and (vii) (1:2:2 in weight ratio)
(v) 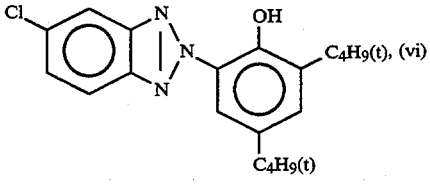
, (vi) 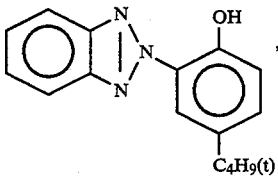
,
and
(vii) 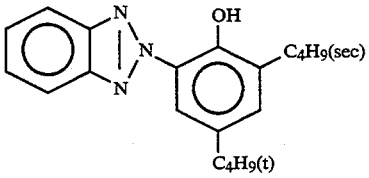
(Solv-1) Solvent
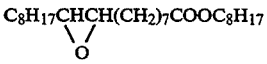
(Solv-2) Solvent
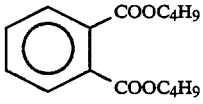
(Solv-3) Solvent
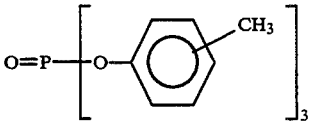
(Solv-4) Solvent -continued

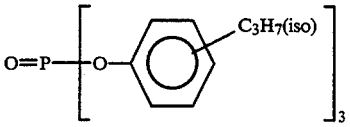

(Solv-5) Solvent

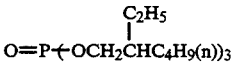

(Solv-6) Solvent

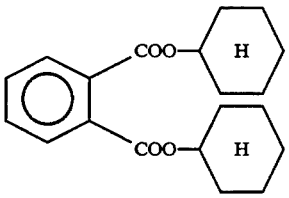

(Solv-7) Solvent

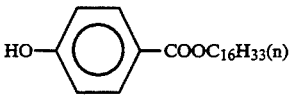

Photographic materials II and III were prepared in the same manner as photographic material I, except that the gelatin amount in each layer and the coated amount of silver were changed as shown in Table 2. Further, photographic materials 101 to 129 were prepared based on the above-prepared photographic materials I, II, and III, by combinations of whether a new hydrophilic colloid layer is provided by coating between the first layer (blue-sensitive emulsion layer) and the support or not and changing emulsions used in the first layer (blue-sensitive emulsion layer), the third layer (green-sensitive emulsion layer), and the fifth layer (red-sensitive layer). Compositions of prepared photographic materials are shown in Table 3. (The calcium content of gelatins used in these photographic materials 101 to 129 was 750 ppm.)

TABLE 2

| | PM I Coating amount ($g/m^2$) | | PM II Coating amount ($g/m^2$) | | PM III Coating amount ($g/m^2$) | |
|---|---|---|---|---|---|---|
| | Silver | Gelatin | Silver | Gelatin | Silver | Gelatin |
| First layer | 0.27 | 1.26 | 0.30 | 0.75 | 0.19 | 2.27 |
| Second layer | — | 0.80 | — | 0.40 | — | 1.60 |
| Third layer | 0.13 | 1.40 | 0.25 | 0.84 | 0.11 | 2.50 |
| Fourth layer | — | 0.65 | — | 0.33 | — | 1.30 |
| Fifth layer | 0.20 | 0.80 | 0.30 | 0.48 | 0.14 | 1.44 |
| Sixth layer | — | 0.50 | — | 0.25 | — | 1.0 |
| Seventh layer | — | 1.00 | — | 0.50 | — | 2.0 |
| Total amount | 0.60 | 6.41 | 0.85 | 3.55 | 0.44 | 12.11 |

Note;
PM: Photographic Material

TABLE 3

| PM* No. | Base PM* | Composition of No. 0 layer | Emulsion in layer: Blue-sensitive | Green-sensitive | Red-sensitive | Total coating amount of gelatin (A) | Coating amount of silver (B) | A/B | Remarks |
|---|---|---|---|---|---|---|---|---|---|
| 101 | II | — | A - 1 | B - 1 | C - 1 | 3.55 | 0.85 | 4.17 | Comparison |
| 102 | | Gelatin: 0.5 $g/m^2$ | A - 1 | B - 1 | C - 1 | 4.05 | 0.85 | 4.76 | " |
| 103 | | | A - 2 | B - 2 | C - 2 | " | " | " | " |
| 104 | | | A - 3 | B - 3 | C - 3 | " | " | " | " |
| 105 | | | A - 4 | B - 4 | C - 4 | " | " | " | " |
| 106 | | Gelatin: 0.5 $g/m^2$ | A - 1 | B - 1 | C - 1 | 4.05 | 0.85 | 4.76 | " |
| 107 | | White Pigment: | A - 2 | B - 2 | C - 2 | " | " | " | " |
| 108 | | 3.2 $g/m^2$ (86 wt %) | A - 3 | B - 3 | C - 3 | " | " | " | " |
| 109 | | | A - 4 | B - 4 | C - 4 | " | " | " | " |
| 110 | | Gelatin: 2.0 $g/m^2$ | A - 1 | B - 1 | C - 1 | 5.55 | 0.85 | 6.53 | This Invention |
| 111 | | White Pigment: | A - 2 | B - 2 | C - 2 | " | " | " | Comparison |
| 112 | | 3.2 $g/m^2$ (62 wt %) | A - 3 | B - 3 | C - 3 | " | " | " | " |
| 113 | | | A - 4 | B - 4 | C - 4 | " | " | " | This Invention |
| 114 | I | — | A - 1 | B - 1 | C - 1 | 6.41 | 0.60 | 10.68 | Comparison |
| 115 | | Gelatin: 0.6 $g/m^2$ | A - 1 | B - 1 | C - 1 | 7.01 | 0.60 | " | This Invention |
| 116 | | White Pigment: | A - 2 | B - 2 | C - 2 | " | " | " | Comparison |
| 117 | | 3.2 $g/m^2$ (84 wt %) | A - 4 | B - 4 | C - 4 | " | " | " | This Invention |
| 118 | I | Gelatin: 2.0 $g/m^2$ | A - 1 | B - 1 | C - 1 | 8.41 | 0.60 | 14.02 | This Invention |
| 119 | | White Pigment: | A - 2 | B - 2 | C - 2 | " | " | " | Comparison |
| 120 | | 3.2 $g/m^2$ (62 wt %) | A - 4 | B - 4 | C - 4 | " | " | " | This Invention |
| 121 | | Gelatin: 4.5 $g/m^2$ | A - 1 | B - 1 | C - 1 | 10.91 | 0.60 | 18.18 | " |
| 122 | | White Pigment: | A - 2 | B - 2 | C - 2 | " | " | " | Comparison |

TABLE 3-continued

| PM* No. | Base PM* | Composition of No. 0 layer | Emulsion in layer Blue-sensitive | Green-sensitive | Red-sensitive | Total coating amount of gelatin (A) | Coating amount of silver (B) | A/B | Remarks |
|---|---|---|---|---|---|---|---|---|---|
| | | 8 g/m² (64 wt %) | | | | | | | |
| 123 | III | — | A - 1 | B - 1 | C - 1 | 12.11 | 0.44 | 27.5 | Comparison |
| 124 | | Gelatin: 0.6 g/m² | A - 1 | B - 1 | C - 1 | 12.71 | 0.44 | 28.99 | This Invention |
| 125 | | White Pigment: | A - 2 | B - 2 | C - 2 | " | " | " | Comparison |
| | | 3 g/m² (83 wt %) | | | | | | | " |
| 126 | | — | A - 1 | B - 1 | C - 1 | 14.61 | 0.44 | 33.20 | Comparison |
| 127 | | Gelatin: 2.5 g/m² | A - 2 | B - 2 | C - 2 | " | " | " | " |
| 128 | | White Pigment: | A - 3 | B - 3 | C - 3 | " | " | " | " |
| 129 | | 3 g/m² (55 wt %) | A - 4 | B - 4 | C - 4 | " | " | " | |

Note;
*PM: Photographic Material

The prepared photographic materials, after the hardening reaction being completed, stored in the following two ways.

(Condition of storage)

(a) Storage in cooled at 10° C. for 2 days (b) Storage at 60° C., 40% RH for 2 days (Exposure to light)

A sensitometer (manufactured by Fuji Photo Film Co., Ltd.; FWH type; the color temperature of the light source: 3200 K.) was used and gradation exposure was given through a gradation wedge having a color separation filter for sensitometry. The exposure at that time was such that the exposure amount was 2500 CMS per sec of the exposure time.

The exposed samples were subjected to color development processing in the below processing steps using a paper processor.

The logarithm of the reciprocal of the quantity of light required to give a yellow density of 1.0 in the blue-sensitive layer of each sample of the storage conditions (a) and (b) was determined, to find sensitivity S(a) (the sensitivity of the sample stored under the storage condition (a) that was developed for 45 sec) and sensitivity S(b) (the sensitivity of the sample stored under the storage condition (b) that was developed for 45 sec). The difference $\Delta S_1=[S(b)-S(a)]$ between the sensitivities was designated as the scale of the change of the sensitivity at the time of the storage of the photographic material.

The samples stored under the condition (a) were also processed for a development time of 30 sec, and similarly the sensitivity S((a) 30") was found. The difference $\Delta S_2=[S(a)-S((a)\ 30")]$ between the sensitivity S(a) of the development time of 45 sec and the sensitivity S((a) 30") was designated as the scale of the speed of the progress of the development of the photographic material. (It means that the greater this value is, the slower the speed of the progress of the development is.)

In order to evaluate the sharpness of the photographic material, using as the light source of a sensitometer (manufactured by Fuji Photo Film Co., Ltd.), light passed through a metallized interference filter 700 nm, the photographic material was exposed to light with an optical wedge having a rectangular pattern with various frequencies in contact with the photographic material to find the resolution of the cyan color formation. As the indication of the resolution, the number C of frequencies (lines/mm) at which the CTF (contrast transfer function) value [the ratio $\Delta D_c/\Delta D_0$ wherein the $\Delta D_0$ represents the density difference between the high-density section and the low-density section at the time when the section of the high quantity of light and the section of the low quantity of light were continuously exposed to light over a very wide area with the frequencies of the rectangular pattern being 0, i.e., no repetition of a rectangular pattern and the $\Delta D_c$ represents the density difference between the high-density section and the low-density section at the time when the section of the high quantity of light and the section of the low quantity of light were continuously exposed to light over a very wide area with the frequencies of the rectangular pattern being C (lines/mm)] becomes 0.5 was determined. (It means that the greater the value of this C is, the higher the sharpness is.)

| Processing step | Temperature | Time | Replenisher* | Tank Volume |
|---|---|---|---|---|
| Color developing | 35° C. | 45 sec | 161 ml | 17 liter |
| Bleach-fixing | 30–35° C. | 45 sec | 215 ml | 17 liter |
| Rinse (1) | 30–35° C. | 20 sec | — | 10 liter |
| Rinse (2) | 30–35° C. | 20 sec | — | 10 liter |
| Rinse (3) | 30–35° C. | 20 sec | 350 ml | 10 liter |
| Drying | 70–80° C. | 60 sec | | |

Note:
*Replenisher amount per m² of photographic material.

Rinsing steps were carried out on 3-tanks countercurrent mode from the tank of rinsing (3) toward the tank of rinsing (1).

The composition of each processing solution is as followed, respectively:

| | Tank Solution | Replenisher |
|---|---|---|
| Color-developer | | |
| Water | 800 ml | 800 ml |
| Ethylenediamine-N,N,N',N'-tetramethylene phosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-aminoaniline sulfate | 5.0 g | 7.0 g |
| N,N-Bis(carboxymethyl)hydrazine | 4.0 g | 5.0 g |
| Monosodium N,N-di(sulfoethyl) hydroxylamine | 4.0 g | 5.0 g |
| Fluorescent whitening agent (WHITEX-4B, made by Sumitomo Chemical Ind.) | 1.0 g | 2.0 g |
| Water to make | 1000 ml | 1000 ml |
| pH (25° C.) | 10.05 | 10.45 |

Bleach-fixing solution
(Both tank solution and replenisher)

| | |
|---|---|
| Water | 400 ml |
| Ammonium thiosulfate (700 g/l) | 100 ml |
| Sodium sulfite | 17 g |
| Iron (III) ammonium ethylenediaminetetraacetate | 55 g |
| Disodium ethylenediaminetetraacetate | 5 g |
| Ammonium bromide | 40 g |
| Water to make | 1000 ml |

-continued

| | Tank Solution | Replenisher |
|---|---|---|
| pH (25° C.) | 6.0 | |

Rinse solution
(Both tank solution and replenisher)

Ion-exchanged water (calcium and magnesium each are 3 ppm or below)

Results obtained are shown in Table 4.

TABLE 4

| PM* No. | Frequency C Cyan (line/mm) (Sharpness) | Sensitivity S (a)** | $\Delta S_1$ (Change of sensitivity during storage) | $\Delta S_2$ (Behavior at progress of development) | Remarks |
|---|---|---|---|---|---|
| 101 | 15.0 | 0 | +0.01 | +0.02 | Comparison |
| 102 | 14.1 | −0.01 | +0.01 | +0.03 | " |
| 103 | 14.0 | −0.02 | 0 | +0.09 | " |
| 104 | 14.2 | −0.04 | −0.01 | +0.12 | " |
| 105 | 13.9 | −0.29 | +0.01 | +0.02 | " |
| 106 | 20.3 | −0.01 | +0.10 | +0.03 | " |
| 107 | 20.2 | −0.02 | +0.02 | +0.10 | " |
| 108 | 20.1 | −0.04 | +0.01 | +0.13 | " |
| 109 | 20.4 | −0.30 | +0.06 | +0.02 | " |
| 110 | 20.4 | +0.01 | +0.03 | +0.03 | This Invention |
| 111 | 19.9 | −0.02 | +0.01 | +0.11 | Comparison |
| 112 | 19.8 | −0.05 | +0.01 | +0.14 | " |
| 113 | 20.0 | −0.28 | +0.02 | +0.03 | This Invention |
| 114 | 15.1 | −0.01 | 0 | +0.02 | Comparison |
| 115 | 20.5 | −0.01 | +0.03 | +0.03 | This Invention |
| 116 | 20.4 | −0.03 | +0.01 | +0.11 | Comparison |
| 117 | 20.6 | −0.29 | +0.02 | +0.02 | This Invention |
| 118 | 19.8 | +0.01 | +0.02 | +0.03 | " |
| 119 | 19.8 | −0.03 | +0.01 | +0.12 | Comparison |
| 120 | 20.0 | −0.28 | +0.01 | +0.03 | This Invention |
| 121 | 19.9 | ±0 | +0.02 | +0.04 | " |
| 122 | 19.8 | −0.03 | +0.02 | +0.16 | Comparison |
| 123 | 14.3 | −0.01 | +0.02 | +0.04 | " |
| 124 | 20.1 | −0.02 | +0.02 | +0.06 | This Invention |
| 125 | 19.9 | −0.04 | +0.03 | +0.19 | Comparison |
| 126 | 20.3 | −0.03 | +0.01 | +0.08 | " |
| 127 | 20.4 | −0.05 | +0.01 | +0.13 | " |
| 128 | 20.1 | −0.06 | −0.01 | +0.20 | " |
| 129 | 20.3 | −0.32 | +0.01 | +0.08 | " |

Note;
*PM: Photographic material
**Sensitivity is designated in relative sensitivity assuming the sensitivity of photographic material 101 as being 0.

As is apparent from the results shown in Table 4, when a hydrophilic colloid layer containing white pigment is provided between the blue-sensitive layer and the support of photographic material using a high-silver-chloride emulsion A-1, A-4, B-1, B-4, C-1, or C-4, the sharpness of photographic material become good, but the change of sensitivity of blue-sensitive emulsion layer due to storage increases (comparing 106 and 109 with 102 and 105). However, this phenomenon is not almost observed in the case using a silver halide emulsion containing low-silver-chloride emulsion (comparing 107 and 108 with 103 and 104). The increase of sensitivity change of blue-sensitive emulsion layer is largely improved by increasing the ratio of total amount (solid) (in g/m$^2$) of hydrophilic colloid applied on the support to the total coating amount (g/m$^2$ in terms of silver) photosensitive silver halide to 5.0 or more (comparing 106 with 110 and 115). It is also noticed, however, when this ratio exceeds 30.0, the speed of the progress of development becomes slow, resulting the rapid processing ability that is essential object of the present invention being lost (126 to 129). Further, the effect at storage is most remarkable when the ratio of between 13.0 and 20.0.

Further, emulsions sensitized by gold (A-1, B-1, and C-1) have higher sensitivity and are more effective than emulsions sensitized by only sulfur (A-4, B-4, and C-4)(comparing 106 with 110 and 115, and comparing 109 with 113 and 117).

Thus, a photographic material excellent in sharpness, capable of being processed rapidly, and improved in preservability can be provided in the scope of the present invention.

EXAMPLE 2

Photographic materials 206 to 213 and 215 to 222 were prepared in the same manner as photographic materials 106 to 113 and 115 to 122 in Example 1, except that two nonphotosensitive layers (a) and (b) having composition shown below were provided on No. 0 layer in the order shown below.

| | |
|---|---|
| Layer (a): | |
| Black colloidal silver | 0.11 |
| Gelatin | 0.99 |
| Color-mix inhibitor (Cpd-4) | 0.08 |
| Solvent (Solv-1) | 0.16 |
| Solvent (Solv-2) | 0.08 |
| Layer (b): | |
| Gelatin | 0.99 |
| Color-mix inhibitor (Cpd-4) | 0.08 |
| Solvent (Solv-2) | 0.16 |
| Solvent (Solv-3) | 0.08 |

Thus-prepared photographic materials were subjected to the same evaluation as in Example 1.

Ratios of total amount of gelatin to the amount of silver were as follows:

7.09 in photographic materials 206 to 209

8.86 in photographic materials 210 to 213
14.98 in photographic materials 215 to 217
17.31 in photographic materials 218 to 220
21.48 in photographic materials 221 and 222

Thus, all the photographic materials were in the scope of the present invention. Changes of sensitivity due to storage of these photographic materials were found being small, showing the similar results as in Example 1.

EXAMPLE 3

With respect to Photographic Materials 101 to 119 and 201 to 209 prepared in Examples 1 and 2, the same evaluation as that in Example 1 was repeated, except that the following exposure to light was carried out. The obtained results were the same as those of Examples 1 and 2.

(Exposure to light)

473 nm taken out by changing the wavelength of a YAG solid state laser (the emitting wavelength: 946 nm) using as a light source an excited semiconductor laser GaAlAs (the emitting wavelength: 808.5 nm) by an SHG crystal of $KNbO_3$, 532 nm taken out by changing the wavelength of a $YVO_4$ solid state laser (the emitting wavelength: 1064 nm) using as a light source an excited semiconductor laser GaAlAs (the emitting wavelength: 808.7 nm) by an SHG crystal of KPT, and AlGaInP (the emitting wavelength: about 670 nm; Type No. TOLD9211 manufactured by Toshiba) were used. The apparatus can carry out the exposure in such a manner that laser beams can scan successively a color photographic printing paper moving normally to the direction of the scanning by respective rotating polyhedrons. Using this apparatus to change the quantity of light, the relationship D−log E between the density (D) of the photographic material and the quantity of light (D) was determined. At that time, the quantities of the lights of laser beams having three wavelengths were modulated by using an external modulator to control the exposure amount. The scanning exposure was carried out at 400 dpi and the average exposure time per picture element was about $5\times10^{-8}$ sec. The temperature of the semiconductor laser was kept by using a Peltier device to prevent the quantity of light from being changed by temperature.

EXAMPLE 4

Photographic materials 401 to 429 and 501 to 529 were prepared in the same manner as photographic materials 101 to 129 in Example 1, except that gelatin having a calcium content of 2,000 ppm was used for photographic material 401 to 429, and gelatin having a calcium content of 200 ppm was used for photographic material 501 to 529, each instead of gelatin having a calcium content of 750 ppm for photographic material 101 to 129 in Example 1.

As results of conducting the same evaluation as Example 1 with respect to photographic materials 101 to 129, 401 to 429, and 501 to 529, differences in sharpness and behavior in progress of development due to the difference of calcium content were not almost found. However, differences in change of sensitivity ($\Delta S_1$) during storage due to the difference of calcium content occurred, as shown in Table 5.

TABLE 5

| PM* No. | $\Delta S_1$ (Change of sensitivity during storage) Amount of Calcium in gelatin: 1,000 ppm (PM No. 400-series) | Amount of Calcium in gelatin: 750 ppm (PM No. 100-series) | Amount of Calcium in gelatin: 200 ppm (PM No. 500-series) |
|---|---|---|---|
| 01 | +0.01 | +0.01 | +0.01 |
| 02 | +0.01 | +0.01 | +0.01 |
| 03 | +0.01 | 0 | 0 |
| 04 | 0 | −0.01 | 0 |
| 05 | +0.01 | +0.01 | +0.01 |
| 06 | +0.11 | +0.10 | +0.09 |
| 07 | +0.02 | +0.02 | +0.02 |
| 08 | +0.01 | +0.01 | +0.01 |
| 09 | +0.07 | +0.06 | +0.06 |
| 10 | +0.05 | +0.03 | +0.01 |
| 11 | +0.01 | +0.01 | +0.01 |
| 12 | +0.02 | +0.01 | +0.01 |
| 13 | +0.04 | +0.04 | +0.04 |
| 14 | +0.01 | 0 | +0.01 |
| 15 | +0.05 | +0.03 | +0.01 |
| 16 | +0.01 | +0.01 | +0.01 |
| 17 | +0.04 | +0.04 | +0.04 |
| 18 | +0.04 | +0.02 | +0.01 |
| 19 | +0.01 | +0.01 | +0.01 |
| 20 | +0.04 | +0.04 | +0.04 |
| 21 | +0.04 | +0.02 | +0.01 |
| 22 | +0.02 | +0.02 | +0.02 |
| 23 | +0.04 | +0.02 | +0.01 |
| 24 | +0.03 | +0.02 | +0.02 |
| 25 | +0.03 | +0.03 | +0.03 |
| 26 | +0.02 | +0.01 | +0.01 |
| 27 | +0.01 | +0.01 | +0.01 |
| 28 | −0.01 | −0.01 | −0.01 |
| 29 | +0.01 | +0.01 | +0.01 |

Note;
*PM: Photographic material
PM No. is designated in lower two orders of each 400-series, 100-series, or 500-series.

As is apparent in the results in Table 5, remarkable differences of sensitivity during storage that is dependent on the calcium content in the gelatin occur only in the case wherein white pigments are applied in the lower most layer and gold sensitized high-silver-chloride emulsion is used, according to the present invention. The degree of improvement becomes bigger by using gelatin having a calcium content of 800 ppm or less, within the range (ratio of total amount of gelatin to total silver amount) of the present invention.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material having at least three photosensitive emulsion layers that are different in color sensitivity, wherein each contains a different coupler capable of forming a dye selected from yellow, magenta, and cyan colors, silver halide emulsion grains, and a hydrophilic colloid, and at least one hydrophilic colloid layer that is a nonphotosensitive layer, on a support, wherein each of the photosensitive emulsion layers comprises silver halide emulsion grains having 95 mol % or more of silver chloride sensitized with gold, and a hydrophilic colloid layer containing a white pigment is applied between the support and the photosensitive emulsion layer nearest to the support, the weight ratio of the white pigment in said hydrophilic colloid layer being 50 to 99 wt %, and the ratio of the total amount in $g/m^2$ of the hydrophilic colloid in terms of solids applied on the support to the total coating amount in $g/m^2$ of the photosensitive silver halide in terms of silver in the photographic material being in the range from 5.0 to 30.0, wherein gelatin having 800 ppm or less of calcium content is used in at least one of the photosensitive or nonphotosensitive layers, wherein said white pigment is titanium dioxide, and wherein all hydrophilic colloid in said silver halide color photographic material is gelatin.

2. The silver halide color photographic material as claimed in claim 1, wherein at least one nonphotosensitive hydrophilic colloid layer is a colored layer capable of being decolored by processing.

3. The silver halide color photographic material as claimed in claim 1, wherein the ratio of the total amount of hydrophilic colloid applied on the support to the total coating amount of the photosensitive silver halide in the photographic material is in the range from 13.0 to 20.0.

4. The silver halide color photographic material as claimed in claim 1, wherein the amount of white pigment contained in the hydrophilic colloid layer is 0.5 to 15 $g/m^2$.

5. The silver halide color photographic material as claimed in claim 1, wherein the white pigment is contained in an amount of 70 to 99 wt % in the hydrophilic colloid layer.

6. The silver halide color photographic material as claimed in claim 1, wherein the thickness of hydrophilic colloid layer containing white pigment is in the range from 0.5 to 10 $\mu m$.

7. The silver halide color photographic material as claimed in claim 1, wherein the particle diameter of the white pigment particles contained in the hydrophilic colloid layer is 0.1 to 1.0 $\mu m$.

8. The silver halide color photographic material as claimed in claim 1, wherein the total coating amount of photosensitive silver halide in the photographic material is 0.030 to 1.0 $g/m^2$ in terms of silver.

9. The silver halide color photographic material as claimed in claim 1, wherein the silver halide emulsion having a silver chloride content of 95 mol % or more has a silver bromide localized phase in at least one of the silver halide grains and the surface of silver halide grains.

10. The silver halide color photographic material as claimed in claim 9, wherein the silver bromide localized phase contains at least one metal ion or complex of metal, which metal is selected from the group of metals belonging to Groups VIII and IIb of the Periodic Table.

11. A method for forming a color image which comprises exposing light to the silver halide color photographic material as claimed in claim 1 by a scanning exposure system with the exposure time being $10^{-4}$ sec or less per picture element and then color developing.

12. The method for forming a color image as claimed in claim 11, wherein the exposure time by a scanning exposure system is in the range from $10^{-10}$ to $10^{-4}$ sec.

* * * * *